United States Patent [19]

Brolo

[11] 4,199,395

[45] Apr. 22, 1980

[54] DEVICE FOR APPLYING SHEET MATERIAL, SUCH AS LABELS AND THE LIKE, TO A BACKING SURFACE BY MEANS OF TRANSPARENT ADHESIVE TAPE

[76] Inventor: Luigi A. Brolo, Via Litta Modignani 8, Milan, Italy

[21] Appl. No.: 911,036

[22] Filed: May 30, 1978

[51] Int. Cl.[2] ..... B65C 9/12; B65C 11/00

[52] U.S. Cl. ..... 156/510; 156/522; 156/564

[58] Field of Search ..... 156/522, 564, 565, DIG. 29, 156/510, 523, 570

[56] References Cited

U.S. PATENT DOCUMENTS

| | | | |
|---|---|---|---|
| 2,280,460 | 4/1942 | Voigt et al. | 156/522 |
| 2,754,023 | 7/1956 | Sheridan | 156/522 |
| 3,565,722 | 2/1971 | Drake | 156/564 X |
| 3,937,645 | 2/1976 | Ascoli et al. | 156/522 |
| 4,093,500 | 6/1978 | Browne | 156/510 |

FOREIGN PATENT DOCUMENTS

| | | | |
|---|---|---|---|
| 677510 | 6/1939 | Fed. Rep. of Germany | 156/564 |

*Primary Examiner*—Michael G. Wityshyn
*Attorney, Agent, or Firm*—Schuyler, Birch, McKie & Beckett

[57] ABSTRACT

Device for applying sheet material, such as labels and the like, to a backing surface by means of transparent adhesive tape, in combination comprising a box-like element, having provided therein a first housing or container for a roll of transparent adhesive tape, a second housing or container for a pile of labels, and between said two housings or containers a device for cutting said tape in transverse direction.

3 Claims, 5 Drawing Figures

DEVICE FOR APPLYING SHEET MATERIAL, SUCH AS LABELS AND THE LIKE, TO A BACKING SURFACE BY MEANS OF TRANSPARENT ADHESIVE TAPE

This invention relates to a device for applying sheet material, such as labels and the like, to a backing surface by means of transparent adhesive tape.

The problems concerning with the application of labels, plates, photos, addresses and similar sheet materials to a backing surface, such as for example a wall or side of a package on shipment, are well known.

In most cases, these labels, as more generally referred to, may carry the most various data, for instance the sender's and receiver's addresses, as well as technical data relating to the package contents, and may comprise a sheet of paper which is glued to one side of the package.

By this system, an operator must withdraw a label from a pack, spread it with glue and then apply it by manual pressure to the package. Therefore, such a system would involve substantial labour and is time consuming when used for daily shipment of a considerable amount of packages, and further obliges the operator to handle such materials as adhesives and accordingly to a work in conditions of insufficient healthiness.

Another disadvantage in using these inexpensive paper labels is that the latter are by no way sheltered from atmospherical agents. As a result, the writings on the label will often reach the receiver as more or less illegible.

Therefore, it is the object of the present invention to overcome the above mentioned disadvantages by means of a device which is both of ready and functional use under conditions of highest cleanliness, and capable of uniting a transparent adhesive tape and a paper label so that the latter can be readily applied to the package by means of said tape. Thus, the transparent adhesive tape will shelter the paper label from the atmospherical agents.

According to the invention, a device for applying an adhesive tape to labels intended to be glued to packages, is characterized by comprising in combination: a box-like body or casing in which a first seat or housing is provided for a roll of transparent adhesive tape, while provision is also made for a second seat or housing accommodating a pile of labels, and between said two seats or housings a device for cutting said tape in a transverse direction.

The structural and functional features of the invention, as well as the resulting advantages over the prior art will become more apparent when considering the following exemplary description referred to the accompanying drawings, in which.

Figure 1:
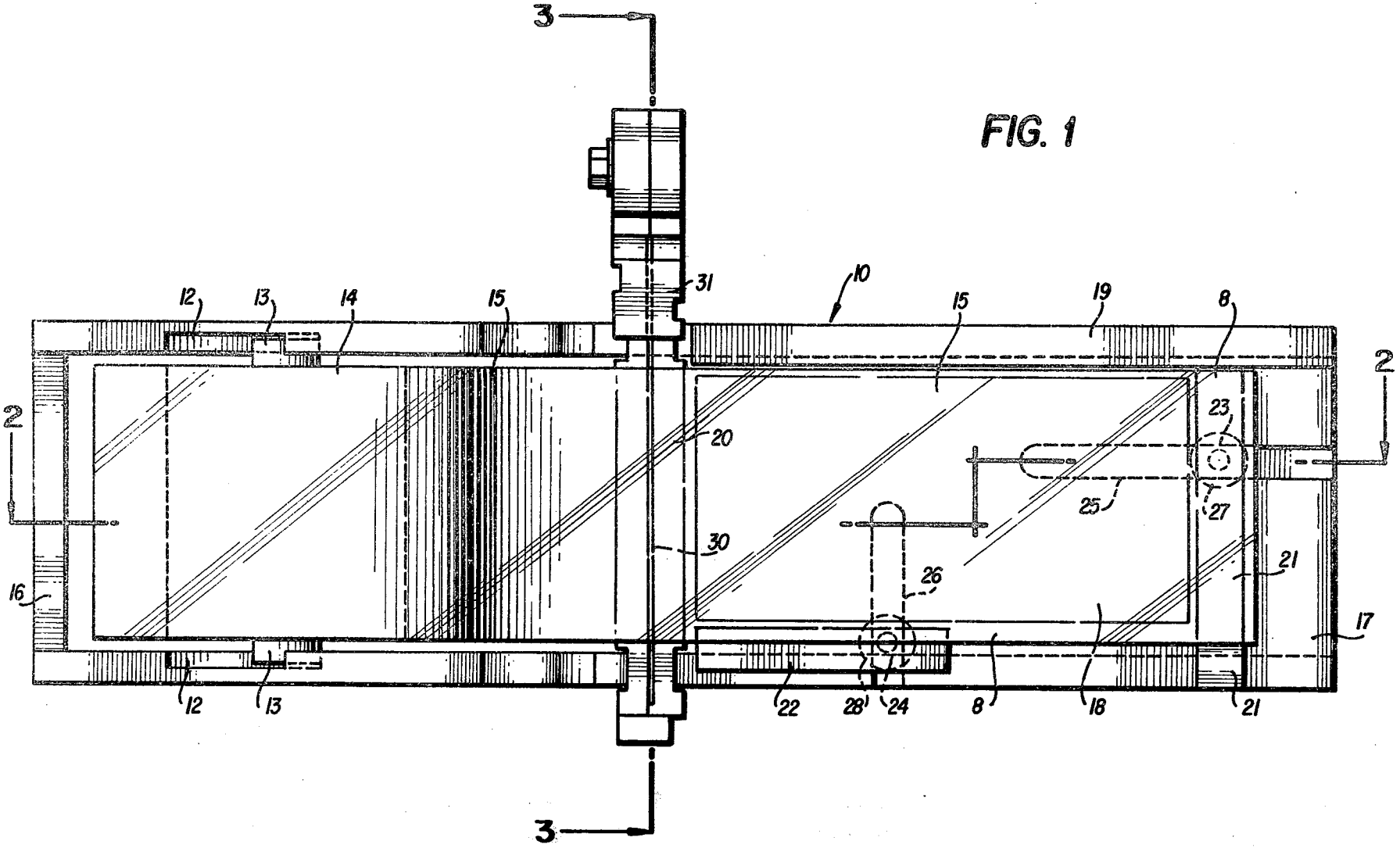
FIG. 1 is a plan view of the device according to the invention.

Referring to the accompanying drawings, a device according to the invention, and designated as a whole at 10, structurally comprises a box-like body or casing, on the sides 11 of which seats 12 are provided for freely removably accommodating a shaft 13 for a roll 14 of a transparent adhesive tape 15.

Said sides 11 are retained together by a head 16 and a plane or planar horizontal panel 17 downstream of roll 14, which plane supports a pile of labels 18.

Labels 18 are accommodated on the top surface of plane 17 within two stationary edges or flanges 19 and 20 and within two adjustable positioning edges or flanges 21 and 22, together forming a rectangular seat or housing of a variable size for such labels. More particularly, said edges 21 and 22 have at the bottom respective tooth elements or lugs 23 and 24 running within slits or slots 25 and 26 of said plane 17 and which can be adjustably clamped by thumb screws 27 and 28, respectively.

Between said plane 17 and roll 14 a device is provided for cutting said tape 15, the device comprising a blade 29 sliding within a groove 30 of edge 20. This blade 29 is secured to a handle 31, the latter being restrained to a flexible cable 32 which by means of a spring recuperator or an extensible return spring 9 always tends to automatically move the cutting device back to the position shown in FIG. 3.

The operation of the above described device is as follows.

Figure 2:
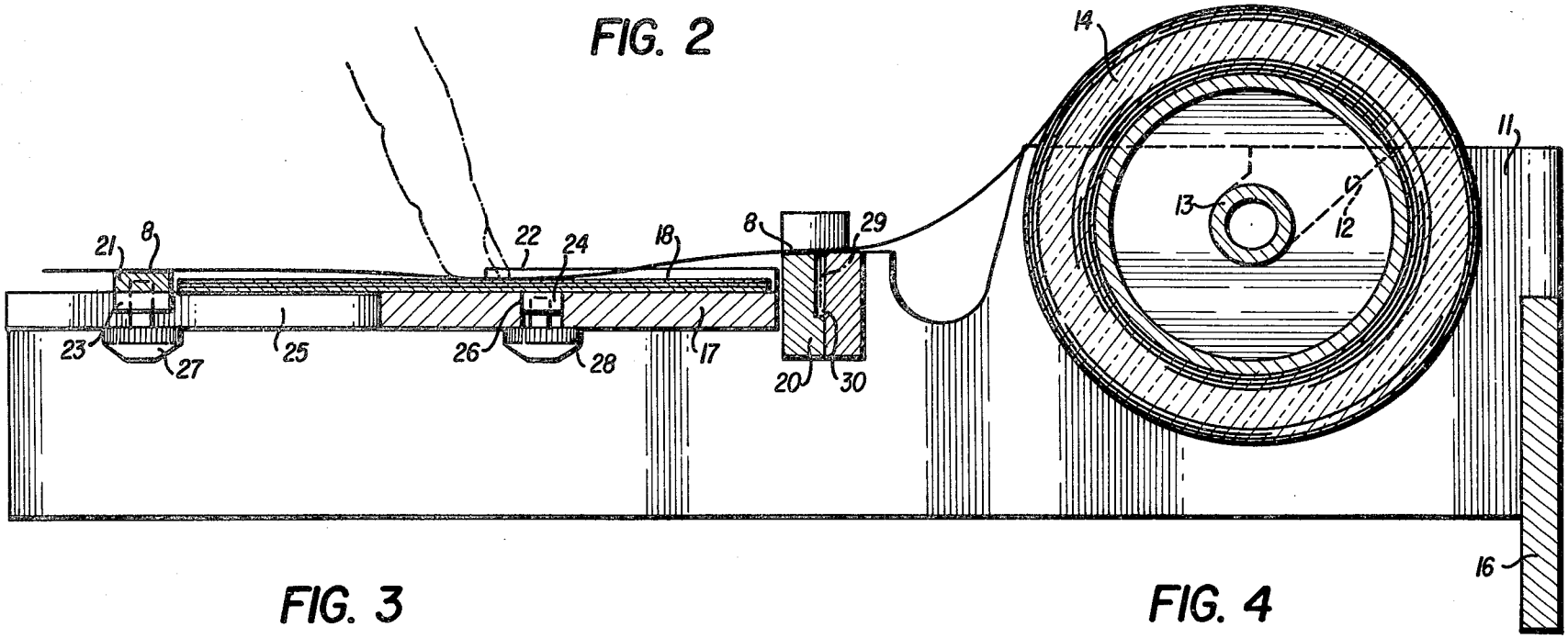
FIG. 2 is a sectional view taken along line 2—2 of FIG. 1.
Figure 5:
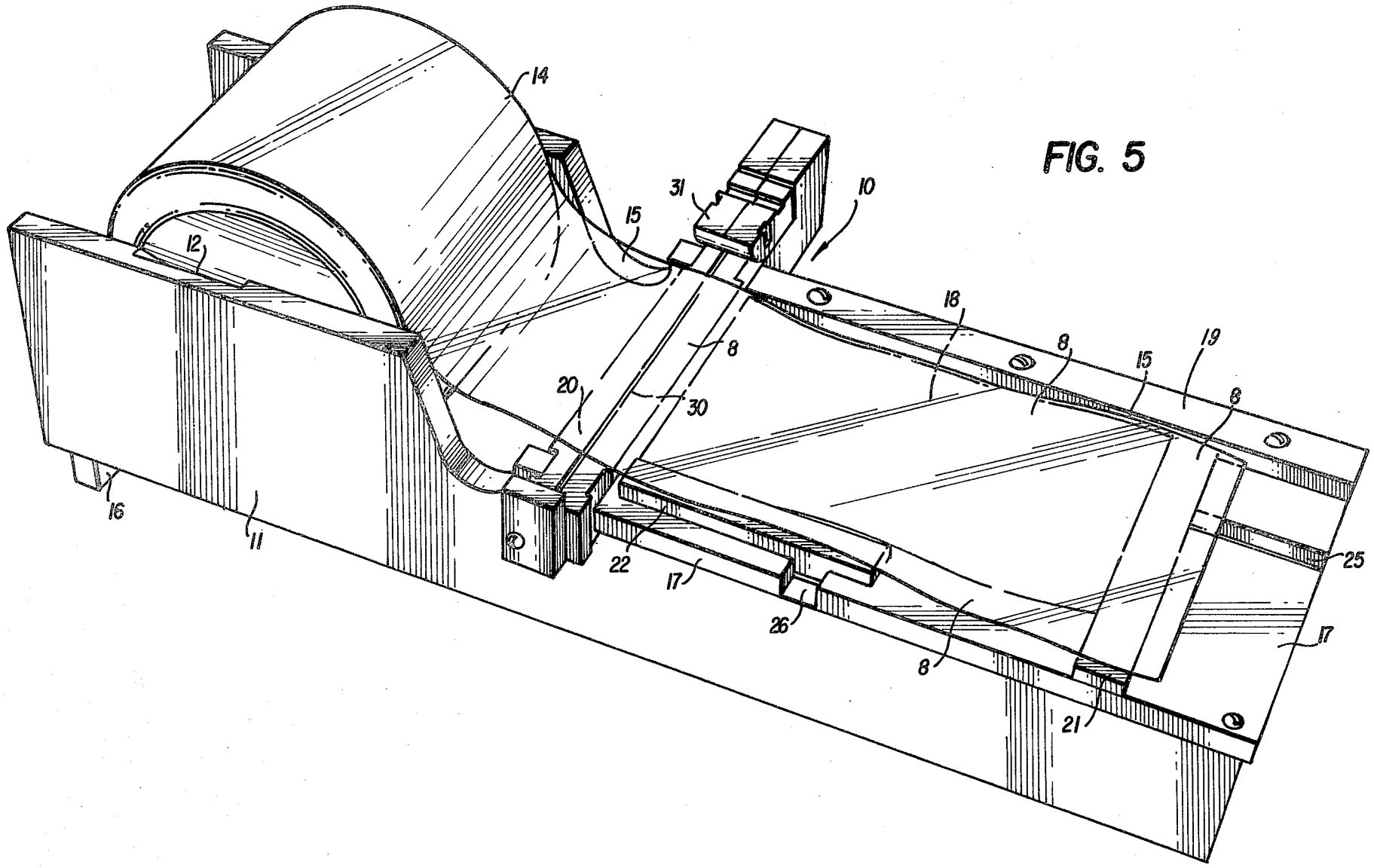
FIG. 5 is a perspective view.

Adhesive tape 15 is manually unwound from roll 14 and its free end is brought to bear on edge 21 at the position shown in FIGS. 1 and 2. Preferably, the width of tape 15 is such that, at the position of FIG. 2, it laterally lies between said edges 19 and 22 of the label seat or housing, in addition to bearing on edges 20 and 21. Then the rectangular portion of tape 15 defined by edges 19, 20, 21 and 22 is of a larger size than that of the underlying rectangular labels 18, as clearly shown in FIG. 5.

Figure 4:
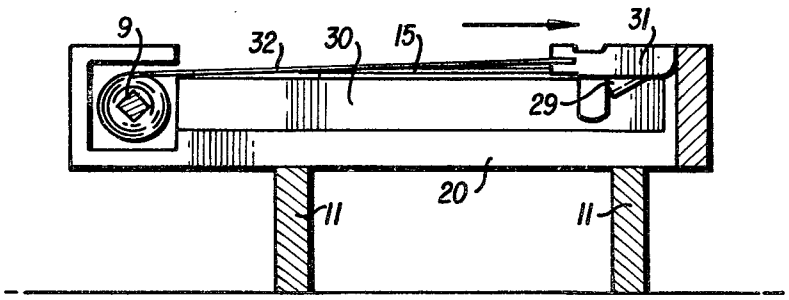
FIG. 4 is a sectional view as that of FIG. 3, but showing the device at a different operating condition.
Figure 3:
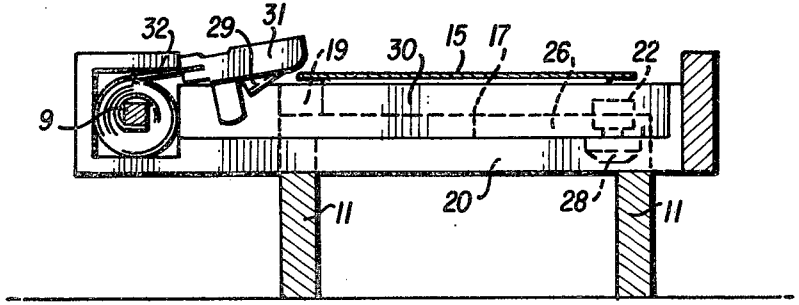
FIG. 3 is a sectional view taken along line 3—3 of FIG. 1.

This being stated, said rectangular portion of tape 15 is separated from the roll by manually displacing said blade 29 from the position shown in FIG. 3 to that shown in FIG. 4. Upon release of handle 31 from the operator, blade 29 owing to the action of said spring recuperator will return to the initial position shown in FIG. 3.

Now, through the pressure of a finger (FIG. 2), the operator will partly attach in limited zones the separated portion of tape 15 to the first label 18 in the pile, which will be withdrawn together with the tape by separating the latter from edges 20 and 21.

The label now appears with perimetrical zones 8 (FIG. 5) of adhesive tape projecting therefrom, by which zones said label can be attached on a package. Thus, it clearly appears that the label attached to the package will be completely covered by the transparent adhesive which, being preferably also impermeabilized, will suitably shelter it from the atmospherical agents.

Of course, the position of the movable edges 21 and 22, as well as the width of the adhesive tape may be varied depending on the size of the labels.

Thus, a device has been provided which in addition to allowing a simple, fast and hygienic application of labels to packages, provides for said labels a protective coating against the atmospherical agents, comprising the same means serving to apply the label to the package.

Although the invention has been described and shown with reference to an embodiment, it will be appreciated that changes and modifications can be applied thereto. For example, the tape cutting device and label seat or housing could be different, and the latter could be also provided with a lifting mechanism for automatically bringing the first label of the pile in gripping contact with the tape. In such a case, the finger pressure operation on the tape (FIG. 2) would be unnecessary.

What I claim is:

1. A device for uniting sheet material, such as labels and the like, and transparent adhesive tape so that the united sheet material and tape can be applied to a surface, in combination comprising a box-like body or element, having provided therein a first seat or housing for a roll of transparent adhesive tape, a second seat or housing for a pile of labels and between said two seats or housings a device for cutting said tape in transverse direction, wherein said cutting device comprises a blade secured to a handle, said blade and handle being partially guided to slide within a groove in said box-like body or element to cut said tape when transversely moved across said tape from a rest position, and return spring means coupled to said handle and blade for returning said handle and blade along said groove to said rest position.

2. A device according to claim 1, wherein said second seat or housing comprises a support plane for the labels, edge means coupled to said plane for defining a seat portion of said plane on which seat portion said labels are supported, said edge means being adjustable to vary the size of said seat portion to accommodate labels of varying size.

3. A device according to claims 1 or 2, wherein said groove is provided within an edge of said label seat or housing.

* * * * *